US007407153B2

(12) United States Patent
Glover

(10) Patent No.: US 7,407,153 B2
(45) Date of Patent: Aug. 5, 2008

(54) CARBURETTOR

(75) Inventor: Stephen Brian Glover, County Kerry (IE)

(73) Assignee: Ricardo UK Limited, West Sussex (GB)

( * ) Notice: Subject to any disclaimer, the term of this patent is extended or adjusted under 35 U.S.C. 154(b) by 0 days.

(21) Appl. No.: 10/574,247

(22) PCT Filed: Sep. 29, 2004

(86) PCT No.: PCT/GB2004/004143

§ 371 (c)(1),
(2), (4) Date: Feb. 28, 2007

(87) PCT Pub. No.: WO2005/033488

PCT Pub. Date: Apr. 14, 2005

(65) Prior Publication Data

US 2007/0132115 A1 Jun. 14, 2007

(30) Foreign Application Priority Data

Sep. 30, 2003 (GB) ..... 0322858.2

(51) Int. Cl.
*F02M 7/24* (2006.01)

(52) U.S. Cl. ..... 261/46; 123/73 PP; 261/55; 261/63; 261/DIG. 1

(58) Field of Classification Search ..... 261/23.2, 261/23.3, 45–47, 54–56, 63, DIG. 1; 123/73 PP
See application file for complete search history.

(56) References Cited

U.S. PATENT DOCUMENTS 6,101,991 A * 8/2000 Glover ..... 123/73 PP (Continued)

FOREIGN PATENT DOCUMENTS

DE 200 20 655 3/2001
WO WO 99/58829 11/1999

OTHER PUBLICATIONS

Patent Abstracts of Japan: Publication No. 2001-295652 published Oct. 26, 2001, Zama Japan KK, (Application No.. 2000-111725 filed Apr. 13, 2000) Stratified Scavenging Two-Cycle Engine.

*Primary Examiner*—Richard L Chiesa
(74) *Attorney, Agent, or Firm*—Cowan, Liebowitz & Latman, P.C.

(57) ABSTRACT

A carburettor for a two stroke engine includes a flow duct including rich and lean flow passages (160, 150) in parallel, through which, in use, air flows in a flow direction and which are separated by substantially planar partition (130). At least one fuel jet (5) communicates with the rich passage (160) and the partition includes an aperture (140) towards which the fuel jet is directed. A substantially planar butterfly valve (120) is received in the aperture so as to be pivotable between a first position, in which the flow duct is substantially closed and the aperture is substantially open, and a second position, in which the flow duct is substantially open and the aperture is substantially closed. The upstream half of the aperture (140) is defined by upstream semi-annular seating ledge (148) affording an upstream seating surface (151), which is engaged by one of the surfaces of the butterfly valve (120), when it is in the second position, and a first end surface (153), which extends between the upstream seating surface and that surface of the partition which is directed towards the lean passage. The downstream half of the aperture (140) is defined by a downstream semi annular seating ledge (149) affording a downstream seating surface (151), which is engaged by the upper surface of the butterfly valve, when it is in the second position, and a second end surface (161), which extends between the downstream seating surface and that surface of the partition which is directed towards the rich passage. At least one of the upstream semi annular seating ledge, the downstream semi-annular seating and the valve are so shaped that, in use, a pressure differential is created between the rich and lean passages at the upstream and/or downstream edges of the valve, the pressure in the lean passage being higher than that in the rich passage.

10 Claims, 2 Drawing Sheets

U.S. PATENT DOCUMENTS 6,634,326 B2 * 10/2003 Radel et al. ..... 123/73 PP
6,889,637 B2 * 5/2005 Rosskamp ..... 123/73 PP
7,011,298 B2 * 3/2006 Gerhardy et al. ..... 261/46
2003/0106508 A1 6/2003 Rosskamp ..... 123/73 PP
2004/0051186 A1 * 3/2004 Gerhardy et al. ..... 261/43
2005/0120985 A1 * 6/2005 Rosskamp ..... 123/73 PP

* cited by examiner

CARBURETTOR

CROSS-REFERENCES TO RELATED APPLICATIONS

This application claims priority to International Application No. PCT/GB2004/00143 filed Sep. 29, 2004, which claims priority to Great Britain Application No. 0322858.2 filed on Sep. 30, 2003, the entire disclosure of which is hereby incorporated by reference.

The present invention relates to carburettors of the type disclosed in WO99/58829. Such carburettors are intended for use with two stroke engines whose inlet duct is divided into two separate passages, referred to as a rich passage and a lean passage. The carburettor is arranged to direct a rich fuel/air mixture into the rich passage and a weak mixture or substantially pure air into the lean passage at high engine load, when the carburettor butterfly valve is substantially fully open, but to direct a substantially equally rich mixture into both the rich and lean passages at low engine load, when the butterfly valve is substantially closed.

The engine with which the carburettor is used is of the crankcase scavenged type and is arranged so that the combustion space is filled with a stratified charge, that is to say a charge whose fuel/air ratio varies over the volume of the combustion space, at high engine load but with a substantially homogeneous charge, that is to say a charge whose fuel/air ratio is substantially the same over the volume of the combustion space, at low engine load. This is achieved in the engine disclosed in WO99/58829 by dividing the interior of the crankcase into two or more separate volumes, one of which, referred to as the rich volume, communicates with the rich passage, and the other of which, referred to as the lean volume, communicates with the lean passage. The rich and lean volumes communicate with the combustion space at different positions.

Under high engine load, the combustion space is scavenged primarily with substantially pure air from the lean volume. The remaining pure air and the rich fuel/air mixture from the rich volume do not mix thoroughly and the charge is stratified. Under low load, there is a similar relatively weak fuel/air mixture in both the rich and lean volumes and the charge in the combustion space is therefore substantially homogeneous.

The carburettor disclosed in WO99/58829 is shown highly schematically here in FIG. 1. The carburettor 1 includes a flow duct comprising rich 60 and lean 50 flow passages in parallel, through which, in use, air flows in a flow direction and which are separated by a substantially planar partition 30, at least one fuel jet 5 communicating with the rich passage 60, the partition 30 including an aperture 40 towards which the fuel jet 5 is directed, and a substantially planar butterfly valve 20 being received in the aperture 40 so as to be pivotable between a first position, in which the flow duct is substantially closed and the aperture 40 is substantially open, and a second position, in which the flow duct is substantially open and the aperture 40 is substantially closed, the upstream half of the aperture 40 being defined by an upstream semi-annular seating ledge 48 affording an upstream seating surface which is engaged by one of the surfaces of the butterfly valve 20 when it is in the second position and a first end surface which extends between the upstream seating surface and that surface of the partition 30 which is directed towards the lean passage 50, the downstream half of the aperture 40 being defined by a downstream semi-annular seating ledge 49 affording a downstream seating surface which is engaged by the other surface of the butterfly valve 20 when it is in the second position and a second end surface, which extends between the downstream seating surface and that surface of the partition 30 which is directed towards the rich passage.

When the engine is idling, the butterfly valve 20 substantially blocks the flow passages 50, 60 and opens the aperture 40. Some of the fuel discharged from the jet 5 can flow through the aperture 40 and is therefore carried generally equally by the airflow into the passages 50 and 60.

In high load operation, the butterfly valve 20 does not block the flow passage but instead closes the aperture 40, ensuring that all the fuel sprayed from the jets 5 flows into the rich passage 60. Substantially pure air flows through the lean passage 50.

The problem with this carburettor is that at high load operation, when the butterfly valve 20 closes the aperture 40, some of the fuel exiting the jets 5 tends to leak through the seal created by closure of the aperture 40 by the valve 20, and escapes into the lean passage 50. This leakage results in a higher concentration of fuel being exhausted from the engine during the scavenging process, leading to higher emission levels than is desired.

In order to meet emissions legislation, it is highly desirable that fuel in the rich passage 60 does not leak into the lean passage 50. However, to use an additional seal such as a rubber seal would add cost and complexity to the manufacture of the carburettor.

It has been identified by the inventor of the present invention that the leakage from the rich passage 60 to the lean passage 50 is due to local pressure gradients across the edges of the valve 20. The internal geometry of the carburettor creates pockets of localised high and low pressure around the valve 20 and the pressure can be locally lower at the valve edge in the lean passage 50 than it is at the valve edge in the rich passage 60. Since gas flows from a high-pressure region to a low-pressure region, the air and fuel in the rich passage 60 tends to seep between the valve 20 and the partition wall 30 into the lean passage 50.

The present invention aims to reduce the likelihood of gas seepage from the rich passage into the lean passage in a simple and effective manner by altering the geometry of the carburettor to redress the pressure differentials across the valve edges, creating an air seal between the two passages.

According to the present invention, there is provided a carburettor for a two stroke engine including a flow duct comprising rich and lean flow passages in parallel, through which, in use, air flows in a flow direction and which are separated by a substantially planar partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the upstream half of the aperture being defined by an upstream semi-annular seating ledge affording an upstream seating surface which is engaged by one of the surfaces of the butterfly valve when it is in the second position and a first end surface which extends between the upstream seating surface and that surface of the partition which is directed towards the lean passage, the downstream half of the aperture being defined by a downstream semi-annular seating ledge affording a downstream seating surface which is engaged by the other surface of the butterfly valve when it is in the second position and a second end surface, which extends between the downstream seating surface and that surface of the partition which is directed towards the rich passage, characterised in that at least one of the upstream semi-annular seating ledge, the downstream semi-annular seating ledge and the valve are so shaped that, in use, a pressure differential is created between the rich and lean passages at at least one of the upstream and downstream ledges of the valve, the pressure in the lean passage being higher than that in the rich passage.

This may be achieved in a number of ways and in one embodiment at least a portion of the downstream seating ledged is of progressively decreasing thickness in the inward direction of the aperture.

This feature may reduce the high pressure in the air flow as it approaches the second end surface of the downstream seating ledge and also reduces the likelihood of flow separation over the downstream seating ledge. The seating ledges are necessary in order to provide stops for the valve as it rotates into the fully closed position. However, the second end surface of the downstream seating ledge of WO99/58829 creates a blockage in the air flow, causing the approaching air to slow down, locally increasing the pressure there. The flow then stagnates against the second end surface, and flow can separate at the sharp lowermost corner of the seating ledge as shown in FIG. 1, producing pressure losses in the separated region and causing a blockage to the unseparated air flow in the remainder of the flow passage.

By altering the geometry of the downstream seating ledge as in the first aspect of the invention, the downstream seating ledge instead experiences a gradual pressure reduction over the second end surface due to the decreasing cross sectional area of the rich passage, reducing the local pressure. The corner at the junction between the second end surface and the surface of the seating ledge directed towards the rich passage is less sharp, reducing the likelihood of a large blockage of the rich passage due to substantial flow separation at this point. The pressure at the valve rich surface in the locality of the valve edge is lowered, reducing the likelihood of gas seepage from the rich passage into the lean passage at the valve downstream edge.

The second end surface may be inclined at an angle of between 3 and 30 degrees and more preferably between 4 and 10 degrees relative to the downstream seating surface. The degree of inclination produces a substantially attached flow over the second end surface in order to achieve a gradual pressure rise over the second end surface.

The rich surface of the valve may lie flush with the rich surface of the partition wall upstream of the valve when the valve fully closes the aperture. Thus, there is no obstacle to the air flowing over the partition wall in the rich passage when it reaches the upstream edge of the valve, reducing the likelihood of flow separation and associated losses in this locality. The terms "rich surface" and "lean surface" of the valve and partition are used to denote those surfaces directed towards the rich and lean passages, respectively.

In a second embodiment of the invention, at least a portion of the upstream seating ledge is of progressively decreasing thickness in the inward direction of the aperture.

This feature may reduce the likelihood of flow separation over the upstream seating ledge. The sharp corner of the downstream seating ledge of WO99/58829 causes air flowing over the seating ledge to separate at the corner, locally reducing the pressure there. The separation can also cause a partial blockage to the unseparated flow in the remainder of the passage. By altering the geometry according to the second aspect of the invention, the flow experiences a more gradual pressure rise due to the gradual expansion of the cross sectional area of the lean passage, locally increasing the pressure at the valve surface. The angle at the junction between the first end surface and the lean surface of the downstream seating ledge directed towards the lean passage is less sharp, reducing the likelihood of flow separation there. The pressure at the lean surface of the valve in the locality of the valve upstream edge is increased, reducing the likelihood of gas seepage from the rich passage into the lean passage at the valve upstream edge.

The first end surface may be inclined at an angle of between 3and 30 degrees to the seating surface and more preferably between 4 and 10 degrees relative to the seating surface.

In a third embodiment of the invention, the valve includes a pivot rod on which it is pivotally mounted for rotation between the said first and second positions, the pivot rod being shaped such that it protrudes into the lean passage only. The result is that when the valve closes the aperture, the rich passage is free of protuberances other than the downstream seating ledge.

Removing the presence of the pivot rod in the rich passage removes a blockage to the flow over the surface of the valve facing towards the rich passage, and produces a greatly reduced likelihood of flow separation over the partition and the valve in the rich passage. This in turn results in the flow remaining attached as it approaches the downstream side of the valve, meaning that any method of flow control to be operated there is more likely to succeed than if a separated flow approached the downstream side of the valve.

In a fourth embodiment of the invention, a part annular wedge is disposed on the surface of the valve that is directed towards the rich passage when the aperture is closed, the wedge comprising an inclined face and a downstream face opposed to the second end surface, the thickness of the wedge increasing from a minimum at the valve surface to a maximum at the wedge downstream face, and arranged such that when the aperture is fully closed a gap is formed between the downstream face of the wedge and a second end surface of the downstream seating ledge.

The presence of the wedge on the valve surface upstream of the downstream seating ledge produces a gradually inclined surface ahead of the seating ledge. As with the first aspect of the invention, the air approaching the seating ledge does not experience a sharp pressure rise ahead of the second end surface, but instead experiences a gradual pressure reduction over the inclined face due to the decreasing cross sectional area of the rich passage, reducing the local air pressure. The sharp corner defining the junction of the inclined face and the downstream face combined with the small gap between the wedge and the downstream seating ledge causes flow to separate at the corner and reattach again to the seating ledge. A reduced pressure is created in the gap between the wedge and the downstream seating ledge and therefore the pressure in the locality of the valve downstream edge is lowered, reducing the likelihood of gas seepage from the rich passage into the lean passage at the valve downstream edge.

The maximum thickness of the wedge may be substantially the same as the thickness of the seating ledge. This increases the likelihood of the flow reattaching to the leading edge of the seating ledge after it has separated from the wedge.

The gap may be significantly smaller than the maximum thickness of the wedge. This also increases the likelihood of the flow reattaching to the leading edge of the seating ledge after it has separated from the wedge. If the gap is too large, then the separated flow may not reattach to the downstream seating ledge and may create a large separation bubble downstream of the wedge, causing a considerable blockage to the flow in the remainder of the passage.

In a fifth embodiment of the invention, a part annular wedge member is disposed on the surface of the valve that is directed towards the lean passage when the aperture is closed, the wedge comprising an upstream face opposed to the first end surface and an inclined face, the thickness of the wedge decreasing from a maximum at its upstream face to a minimum at the valve surface, and arranged such that when the aperture is fully closed, a gap is formed between the upstream face of the wedge and the first end surface of the downstream seating ledge.

The presence of the wedge downstream of the upstream seating ledge produces a gradually inclined surface downstream of the seating ledge. Flow over the seating ledge experiences a gradual pressure increase over the inclined face due to the increasing cross sectional area of the lean passage, reducing the likelihood of separation and increasing the local pressure in comparison to the pressure experienced without the wedge.

The maximum thickness of the wedge may be substantially the same as the thickness of the seating ledge. This increases the likelihood of the flow reattaching to the leading edge of the seating ledge after it has separated from the wedge.

The gap may be significantly smaller than the thickness of the downstream face of the wedge member. This also increases the likelihood of the flow reattaching to the leading edge of the seating ledge after it has separated from the wedge. If the gap is too large, than the separated flow may not reattach and may create a large separation bubble downstream of the wedge, causing a considerable blockage to the flow in the remainder of the passage.

The present invention will now be explained in more detail by the following non-limiting description of preferred embodiments and with reference to the accompanying drawings, in which.

Figure 1:
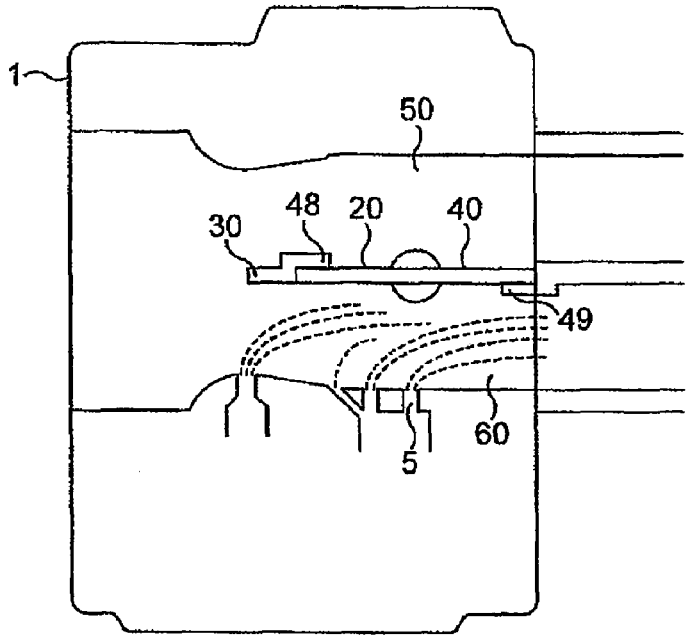
FIG. 1 PRIOR ART
FIG. 1 is a schematic view of a prior art carburettor with the throttle valve fully opened.
Figure 2:
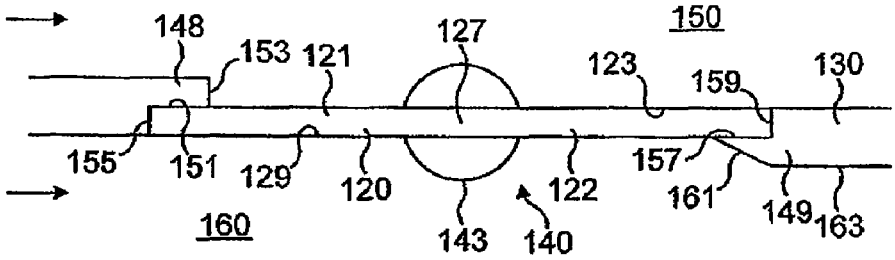
FIG. 2 is a schematic view of a part of a carburettor according to a first aspect of the present invention.

A first embodiment of a carburettor is shown schematically in FIG. 2. The carburettor part has been adapted from the carburettor of FIG. 1, and identical parts have been numbered with the same reference number with the prefix '1'. Thus, FIG. 2 shows a partition wall 130 separating a rich passage 160 from a lean passage 150. An aperture 140 is formed within the partition wall 130, in which is received a butterfly valve 120 for selectively opening and closing the aperture 140 and simultaneously closing and opening the flow duct through the carburettor. The valve 120 comprises a substantially flat disc, shown schematically in profile in FIG. 2. The valve has a lean surface 123 that is directed towards the lean passage 150 and a rich surface 129 that is directed towards the rich passage 160. The valve 120 has an upstream side 121 and a downstream side 122, the demarcation being the pivot rod 143 upon which the valve 120 is mounted. The pivot rod 143 comprises a circular rod that extends through the valve centreline in a direction perpendicular to the flow direction of the carburettor, as defined by the partition wall 130. The diameter of the pivot rod 143 is larger than the thickness of the valve disc 120, and so the pivot rod 143 protrudes from the valve 120 forming generally semi-cylindrical protuberances into the lean passage 150 and the rich passage 160. When the valve 120 is closed or partially closed, the rich passage 160 and lean passage 150 are blocked to the oncoming flow, as the valve 120 throttles the flow through the carburettor. When the valve 120 is open, the rich passage 160 and lean passage 150 are unblocked to the oncoming flow. The arrows to the left of FIG. 2 designate the flow direction.

The aperture 140 is defined by seating ledges 148 and 149. The upstream half of the aperture 140 is defined by the upstream seating ledge 148, which comprises a semi-annular ledge or step of approximately half the thickness of the partition wall 130 integral with the partition wall 130. The upstream seating ledge 148 comprises a seating surface 151 directed towards the rich passage 160 and a first end surface 153 substantially orthogonal to the seating surface 151. The seating ledge 148 has a downstream face 155 that is curved with the same curvature as the valve 120 such that when the valve 120 fully closes the aperture 140, it is seated with a close fit against the downstream face 155 and seating surface 151. The fit between the valve 120 and the seating ledge 148 is very close in order to avoid seepage of gases around the valve edge from the rich passage 160 into the lean passage 150.

The downstream half of the aperture 140 is defined by the downstream seating ledge 149, which also comprises a semi-annular ledge of approximately half the thickness of the partition wall 130. The seating ledge 149 is almost identical to the upstream seating ledge 148 and when the valve 120 fully closes the aperture 140, it is seated against seating surface 157, which is directed towards the lean passage 150, and an upstream face 159 that is curved with the same curvature as the valve 120. However, whereas the first end surface 153 of the upstream seating ledge 148 is substantially orthogonal to the seating surface 151, the corresponding second end surface 161 of the downstream seating ledge 149 is inclined such that the thickness of the downstream seating ledge 149 increases from a minimum at the aperture 140 to a maximum at the rich surface 163 of the partition wall 130.

The angle of inclination of the second end surface 161 relative to the seating surface 157 is approximately seven degrees; the angle is exaggerated in FIG. 2 for clarity. It is usually necessary that the portion of the second end surface 161 closest to the seating surface 157 is not inclined as it can be difficult to manufacture the component with a sharp edge. The edge must also be able to withstand the valve 120 abutting it when the aperture 140 is closed.

In use when the valve 120 fully closes the aperture 140, the flow in the rich passage 160 close to the rich surface 123 of the valve 120 flows over the inclined second end surface 161 without separating from it. The pressure over the second end surface 161 gradually decreases, reducing the local pressure in the vicinity of the valve edge 120. This reduced pressure at the rich surface 129 of the valve 120 reduces the likelihood of gas seepage from the rich passage 160 through to the lean passage 150.

Figure 3:
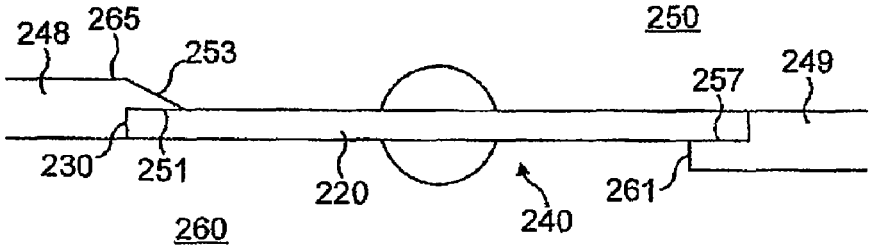
FIG. 3 is a schematic view of a part of a carburettor according to a second aspect of the present invention.

FIG. 3 shows a second embodiment of the invention. The geometry of the valve 220 and partition wall 230 is almost identical to that of the embodiment of FIG. 2. In this embodiment however, the second end surface 261 of the downstream seating ledge 249 remains orthogonal to the seating surface 257 and the first end surface 253 of the upstream seating ledge 248 is inclined such that the thickness of the seating ledge 248 increases from a minimum substantially at the seating surface 251 to a maximum at the surface 265 of the seating ledge 248 that is directed towards the lean passage 250.

The angle of inclination of the first end surface 253 relative to the seating surface 251 is approximately seven degrees; the angle is exaggerated in FIG. 3 for clarity. The angle is small enough that flow over the partition wall 230 in the lean passage 250 does not separate from the inclined first end surface 253. In use when the valve 220 fully closes the aperture 140, the inclined face 253 avoids the separation of the flow thereover and the associated low pressure region that would result from separation, and instead creates a gradual pressure rise over the face 253. This reduces the likelihood of gas seepage from the rich passage 260 into the lean passage 250.

Figure 4:
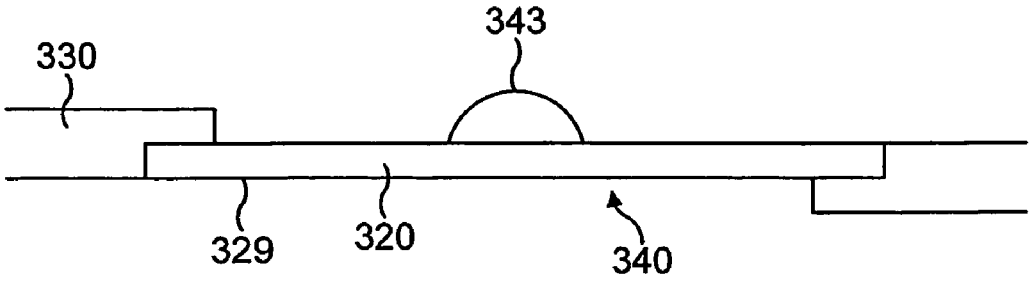
FIG. 4 is a schematic view of a part of a carburettor according to a third aspect of the present invention.

The embodiment shown in FIG. 4 is geometrically almost identical to the carburettor of FIG. 1 (from WO99/58829) with the exception that the lower protuberance of the pivot rod 343 is removed. The pivot rod 343 is in effect flattened or of semi-cylindrical shape so that it lies flush with the rich surface 329 of the valve 320. The pivot rod 343 is securely affixed to the valve 320 using glue or other appropriate fastening means that will not disturb the rich surface 323.

In use when the valve 320 fully closes the aperture 340, the flow over the upstream portion of the partition wall 330 will continue to flow attached to the rich surface 329 of the valve 320. Thus, the high pressure associated with stagnation of the flow at the upstream side of the pivot rod 343 lower hemisphere is avoided, as is the blockage due to separated flow at and immediately downstream of the pivot rod 343.

Figure 5:
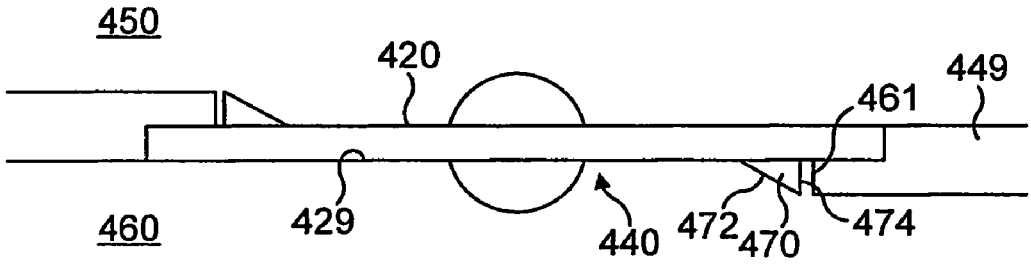
FIG. 5 is a schematic view of a part of a carburettor according to a fifth aspect of the present invention.

The embodiment of FIG. 5 is again very similar to the prior art carburettor shown in FIG. 1, but with the addition of a part-annular wedge section member 470 to the rich surface 429 of the valve 420. The wedge 470 comprises an upstream inclined or smoothly curved face 472 and a downstream face 474. The wedge 470 is affixed to the rich surface 423 of the valve 420 such that the downstream face 474 thereof is parallel to and facing the second end surface 461 of the downstream seating ledge 449, forming a small gap therebetween. The height of the downstream face 474 is approximately equal to the height of the second end surface 461. The wedge 470 thus increases in thickness from a minimum at the valve rich surface 429 to a maximum at the downstream face 474. The inclination of the inclined face 472 is shallow enough to avoid substantial separation of the flow over the wedge 470.

In use when the valve 420 fully closes the aperture 440 and the gases flow over the inclined face 472, the pressure at the surface reduces. The flow separates from the sharp corner at the downstream end of the inclined face 472 and reattaches at the leading edge of the second end surface 461 of the downstream seating ledge 449, creating a reduced pressure in the small gap between the wedge 470 and the seating ledge 449. The air pressure in the locality of the valve edge 420 in the rich passage 460 is reduced, lowering the chance of gas escaping from the rich passage 460 into the lean passage 450.

Figure 6:
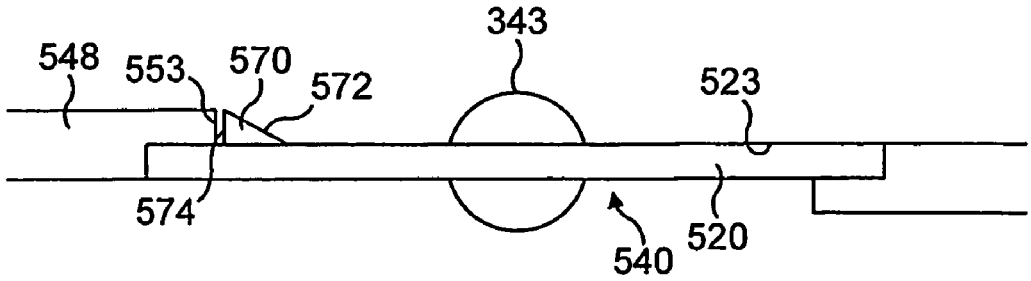
FIG. 6 is a schematic view of a part of a carburettor according to a sixth aspect of the present invention.

The embodiment of FIG. 6 is geometrically identical to the prior art carburettor shown in FIG. 1, but with the addition of a part-annular wedge section member 570 to the lean surface 523 of the valve 520. The wedge 570 comprises a downstream inclined or smoothly curved face 572 and a front face 574. The wedge is affixed to the lean surface 523 of the valve 520 such that the front face 574 thereof is parallel to and facing the end surface 553 of the upstream seating ledge 548, forming a small gap therebetween. The thickness of the front face 574 is approximately equal to the thickness of the end surface 553. The wedge 570 thus decreases in thickness from a maximum at the front face 574 to a minimum at the valve lean surface 523. The inclination of the inclined face 572 is shallow enough to avoid substantial separation of the flow over the wedge 570.

In use when the valve 520 fully closes the aperture 540, the flow over the wedge 570 separates from the sharp corner at the end surface 553 and will reattach at the front face 574/inclined surface 572 junction, creating a reduced pressure in the small gap between the wedge 570 and the seating ledge 548. The pressure increases gradually over the inclined surface 572 as the cross sectional area of the lean passage increases.

It will be evident to the skilled man that two or more of the above embodiments may be utilised in conjunction with one another on the same carburettor where this is appropriate, to minimise the chance of gas seepage from the rich passage into the lean passage when the valve 120 fully closes the aperture 140.

It is noted that for each of the embodiments described herein, the relevant geometrical feature of the invention need not extend around the whole upstream half or the whole downstream half of the seating ledge or valve to which it is applied. Each feature may extend only partially around the upstream half or downstream half of the seating ledge/valve as appropriate.

The invention claimed is:

1. A carburettor for a two stroke engine including a flow duct comprising rich and lean flow passages in parallel separated by a substantially planar partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the upstream half of the aperture being defined by an upstream semi-annular seating ledge affording an upstream seating surface which is engaged by one of the surfaces of the butterfly valve when it is in the second position and a first end surface which extends between the upstream seating surface and that surface of the partition which is directed towards the lean passage, the downstream half of the aperture being defined by a downstream semi-annular seating ledge affording a downstream seating surface which is engaged by the other surface of the butterfly valve when it is in the second position and a second end surface, which extends between the downstream seating surface and that surface of the partition which is directed towards the rich passage, characterised in that at least one of the upstream semi-annular seating ledge, the downstream semi-annular seating ledge and the valve are so shaped that, in use, a pressure differential is created between the rich and lean passages at the upstream and/or downstream edges of the valve, the pressure in the lean passage being higher than that in the rich passage.

2. A carburettor as claimed in claim 1 in which at least a portion of the upstream seating ledge is of progressively decreasing thickness in the inward direction of the aperture.

3. A carburettor as claimed in claim 2 in which the second end surface is inclined at an angle of between 3° and 30° to the downstream seating surface.

4. A carburettor as claimed in any one of the preceding claims in which at least a portion of the upstream seating ledge is of progressively decreasing thickness in the inward direction of the aperture.

5. A carburettor as claimed in claim 4 in which the first end surface in inclined at an angle of between 3° and 30° to the upstream seating surface.

6. A carburettor as claimed in any one of the preceding claims in which the valve includes a pivot rod on which it is pivotally mounted for rotation between the said first and second positions, the pivot rod being shaped such that it protrudes in to the lean passage only.

7. A carburettor as claimed in any one of the preceding claims in which a part annular wedge is disposed on the surface of the valve that is directed towards the rich passage when the aperture is closed, the wedge comprising an inclined face and a downstream face opposed to the second end surface, the thickness of the wedge increasing from a minimum at the valve surface to a maximum at the wedge downstream face, and arranged such that when the aperture is fully closed, a gap is formed between the downstream face of the wedge and the second end surface of the downstream seating ledge.

8. A carburettor as claimed in claim 7 in which the maximum thickness of the wedge is substantially the same as the thickness of the downstream seating ledge.

9. A carburettor as claimed in any one of the preceding claims in which a part annular wedge member is disposed on the surface of the valve that is directed towards the lean passage when the aperture is closed, the wedge comprising an upstream face opposed to the first end surface and an inclined face, the thickness of the wedge decreasing from a maximum at its upstream face to a minimum at the valve surface, and arranged such that when the aperture is fully closed, a gap is formed between the upstream face of the wedge and the first end surface of the downstream seating ledge.

10. A carburettor as claimed in claim 9 in which the maximum thickness of the wedge is substantially the same as the thickness of the upstream seating ledge.

* * * * *